US006095075A

United States Patent [19]

Gordon et al.

[11] Patent Number: 6,095,075

[45] Date of Patent: Aug. 1, 2000

[54] RETRACTABLE BOAT LINE

[75] Inventors: Leslea C. Gordon; Darrel C. Knight, both of 2269 Lakeshore Blvd. West, Suite 2708, Toronto, Ontario, Canada, M8V 3X6; Dusan Nikolic, North York, Canada

[73] Assignees: Leslea C. Gordon; Darrel C. Knight, both of Toronto, Canada

[21] Appl. No.: 09/168,932

[22] Filed: Oct. 9, 1998

[51] Int. Cl.[7] ..... B63B 21/00

[52] U.S. Cl. ..... 114/230.23; 114/230.24; 242/384.7; 242/385.4

[58] Field of Search ..... 114/230.23, 230.24, 114/254; 242/384.7, 385.4

[56] References Cited

U.S. PATENT DOCUMENTS

| | | | |
|---|---|---|---|
| 1,811,400 | 6/1931 | McClellan . | |
| 2,686,491 | 8/1954 | Ohmstede | 114/230.23 |
| 3,012,736 | 12/1961 | Brust | 242/107.5 |
| 3,326,493 | 6/1967 | Bondesen, Jr. | 242/384.7 |
| 3,851,613 | 12/1974 | Armour | 114/230 |
| 3,955,525 | 5/1976 | Seiford, Sr. | 114/235 R |
| 4,476,801 | 10/1984 | Foster et al. | 114/230 |
| 4,697,537 | 10/1987 | Smith | 114/230 |
| 4,722,293 | 2/1988 | Foster et al. | 114/230 |
| 4,726,313 | 2/1988 | Neal | 114/230 |
| 4,809,635 | 3/1989 | Essig | 114/230 |
| 4,846,090 | 7/1989 | Palmquist | 114/230 |
| 4,878,452 | 11/1989 | Regan et al. | 114/293 |
| 5,002,003 | 3/1991 | Blue | 114/230 |
| 5,364,075 | 11/1994 | Montgomery | 254/415 |
| 5,522,336 | 6/1996 | Fujita | 114/293 |

*Primary Examiner*—Sherman Basinger
*Attorney, Agent, or Firm*—Dimock Stratton Clarizio; Mark B. Eisen

[57] ABSTRACT

A retractable boat line for mooring a boat is wound about a payoff reel contained within a stationary housing, which my be mounted beneath the exterior surfaces of the boat, for example within the hull, transom or gunnel. The invention provides a locking mechanism that latches into a guide wall of the payoff reel at a point remote from the edges of the guide wall to rotationally lock the payoff reel relative to the housing. The mooring line can thus be selectively extended to a desired length and remains locked to the selected length until the locking mechanism is disengaged.

12 Claims, 7 Drawing Sheets

RETRACTABLE BOAT LINE

FIELD OF INVENTION

This invention relates to boat mooring devices. In particular, this invention relates to a retractable boat line for securing a boat to a dock, pier or other mooring structure.

BACKGROUND OF THE INVENTION

Mooring or docking a boat conventionally involves tying at least one mooring line between a cleat secured to the boat and a dock, pier, slip or other stationary mooring structure. This can be a difficult and trying task, particularly in rough water where the motion of the boat and slippery wet surfaces can render it difficult to properly secure the mooring line to the boat.

Moreover, the boat must be equipped with a mooring line of sufficient length to accommodate various mooring environments, although in many cases only a portion of the mooring line will be required to secure the boat. The excess mooring line can be difficult to stow neatly, and is thus subject to becoming knotted or tangled, or entangled with persons, cargo or equipment on the boat, which can pose both an inconvenience and a hazard.

Retractable boat lines have been proposed, in which a mooring line is wound about a payoff reel and dispensed as needed to moor the boat under the particular mooring conditions encountered at the time. An example of such a device is described and illustrated in U.S. Pat. No. 4,846,090 issued Jul. 11, 1989 to Palmquist, which is incorporated herein by reference. This patent teaches a spring-loaded reel biased in the take-up direction and provided with a ratchet-type lock which is selectively engaged to ratchet teeth provided along the edges of the reel guide walls, to prevent rotation in the payoff direction when the boat is moored.

However, a moored boat can be subjected to very high peak forces due to wave action and currents. Repetitive momentary tension on the mooring line is transferred to the payoff reel, which in turn subjects the locking mechanism to high momentary stresses. The payoff reel guide walls in such a device, which ear against the locking mechanism, thus become subject to shearing or deformation unless they are formed to a high gauge which adds significant weight to the device, a considerable disadvantage in any type of boating equipment.

Further, the use of a ratchet-type lock with a spring-loaded payoff reel can cause problems due to the oscillating motion experienced by a moored boat in wavy conditions. Where the mooring structure is above the level of the securing point on the boat, as the boat is lifted upwardly by a wave the tension on the mooring line is temporarily released, which allows the reel to turn in the take-up direction. As the crest of the wave passes, the boat begins to fall, but in the newly locked position of the reel the mooring line is too short to allow the boat to freely roll off of the wave, causing the boat to list away from the mooring structure. Similarly, where the mooring structure is below the level of the securing point on the boat, when the boat falls into a trough the tension on the mooring line is temporarily released, which allows the reel to turn in the take-up direction and locks the mooring line so that as the crest of the next wave arrives and lifts the boat the mooring line is too short to allow the boat to rise to the crest of the wave, causing the boat to list toward the mooring structure.

It would accordingly be advantageous to provide a retractable mooring device with a payoff reel that can be locked in both the payoff and take-up directions with minimal effort. It would further be advantageous to provide locking means which engages into the payoff reel at a position remote from the edges of the reel guide walls, so that the locking mechanism can withstand the stresses imparted by the motion of a moored boat while maintaining the weight of the device to a minimum.

SUMMARY OF THE INVENTION

The present invention overcomes these disadvantages by providing a retractable boat line wound about a payoff reel contained within a housing, which can be mounted beneath the exterior surfaces of the boat (for example, within the hull, transom or gunnel) and provides a locking mechanism that latches into a guide wall of the payoff reel at a point remote from the edges of the guide wall. The locking mechanism positively engages the payoff reel and locks same relative to the stationary housing of the device, so that the mooring line can be selectively extended to a desired length and remains locked to the selected length until the locking mechanism is disengaged. In the preferred embodiment the strength of the locking engagement is improved because the guide wall fully surrounds the latch.

In the preferred embodiment the latch is engaged by a manually depressable actuating button cooperating with a retaining dog that retains the button in the depressed (locked) condition. The button and the dog are located exterior to the device, exposed to the user, and provide large surfaces to facilitate the operation of the device in wet and wavy conditions.

In one preferred embodiment of the invention the device is mounted with the plane of rotation of the payoff reel parallel to the mounting surface, and the latch of the locking mechanism is selectively engaged to one of a plurality of openings disposed about the radial surface of the guide wall. In a further preferred embodiment of the invention the device is mounted with the plane of rotation of the payoff reel perpendicular to the mounting surface, and the latch of the locking mechanism is selectively engaged to one of a plurality of openings disposed about a circumferential extension of the guide wall.

The present invention thus provides a retractable mooring line for mooring a boat, comprising a stationary housing for mounting the device a payoff reel rotatably mounted within the housing having guide walls for retaining the mooring line on the reel, for extending and retracting the mooring line, and a locking mechanism comprising at least one latch disposed in alignment with a plurality of openings in at least one guide wall, the latch being movable upon actuation of an actuating member between an unlocked position in which the latch is retracted from the at least one guide wall and a locked position in which the latch extends into at least one of the plurality of openings to thereby rotationally lock the payoff reel to the housing, wherein when the device is mounted to a surface of a boat the actuating member is exposed for manual actuation and the mooring line is exposed for extension to a mooring structure.

The present invention further provides a retractable mooring line for mooring a boat, comprising a stationary housing for mounting the device, a payoff reel rotatably mounted within the housing having guide walls for retaining the mooring line on the reel, for extending and retracting the mooring line, and a locking mechanism comprising at least one latch disposed in alignment with a plurality of openings provided in a radial surface of at least one guide wall, the latch being movable upon actuation of an actuating member between an unlocked position in which the latch is retracted from the at least one guide wall and a locked position in which the latch extends into at least one of the plurality of openings to thereby rotationally lock the payoff reel to the housing, wherein when the device is mounted to a surface of a boat such that the payoff reel rotates in a plane substantially parallel to the surface, the actuating member being exposed for manual actuation and the mooring line being exposed for extension to a mooring structure.

The present invention further provides a retractable mooring line for mooring a boat, a stationary housing for mounting the device a payoff reel rotatably mounted within the housing having guide walls for retaining the mooring line on the reel, for extending and retracting the mooring line, a locking mechanism comprising at least one latch disposed in alignment with a plurality of openings provided in a circumferential extension of a radial surface of at least one guide wall, the latch being movable upon actuation of an actuating member between an unlocked position in which the latch is retracted from the at least one guide wall and a locked position in which the latch extends into at least one of the plurality of openings to thereby rotationally lock the payoff reel to the housing, wherein when the device is mounted to a surface of a boat such that the payoff reel rotates in a plane substantially perpendicular to the surface the actuating member is exposed for manual actuation and the mooring line is exposed for extension to a mooring structure.

BRIEF DESCRIPTION OF THE DRAWINGS

In drawings which illustrate by way of example only a preferred embodiment of the invention.

DETAILED DESCRIPTION OF THE INVENTION

Figure 1:
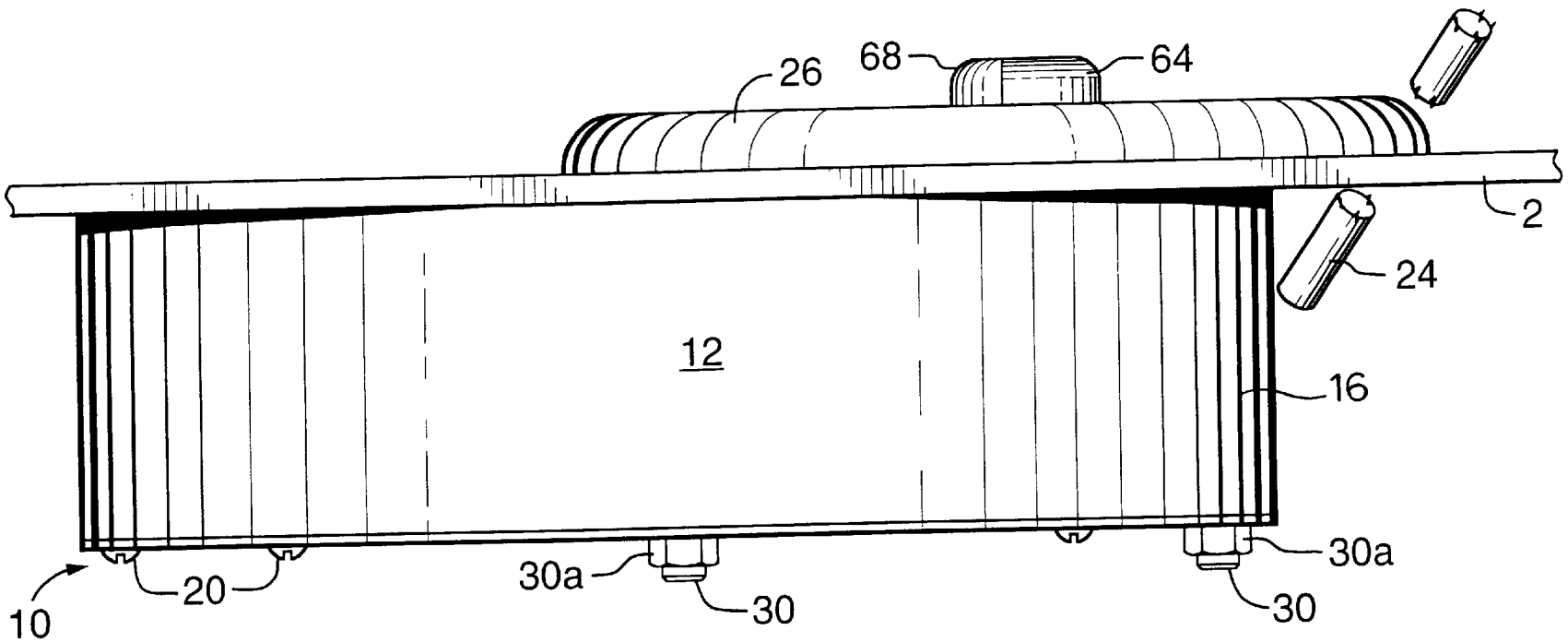
FIG. 1 is a side elevation of a first preferred embodiment of the invention for mounting laterally to a mounting surface on a boat.
Figure 2:
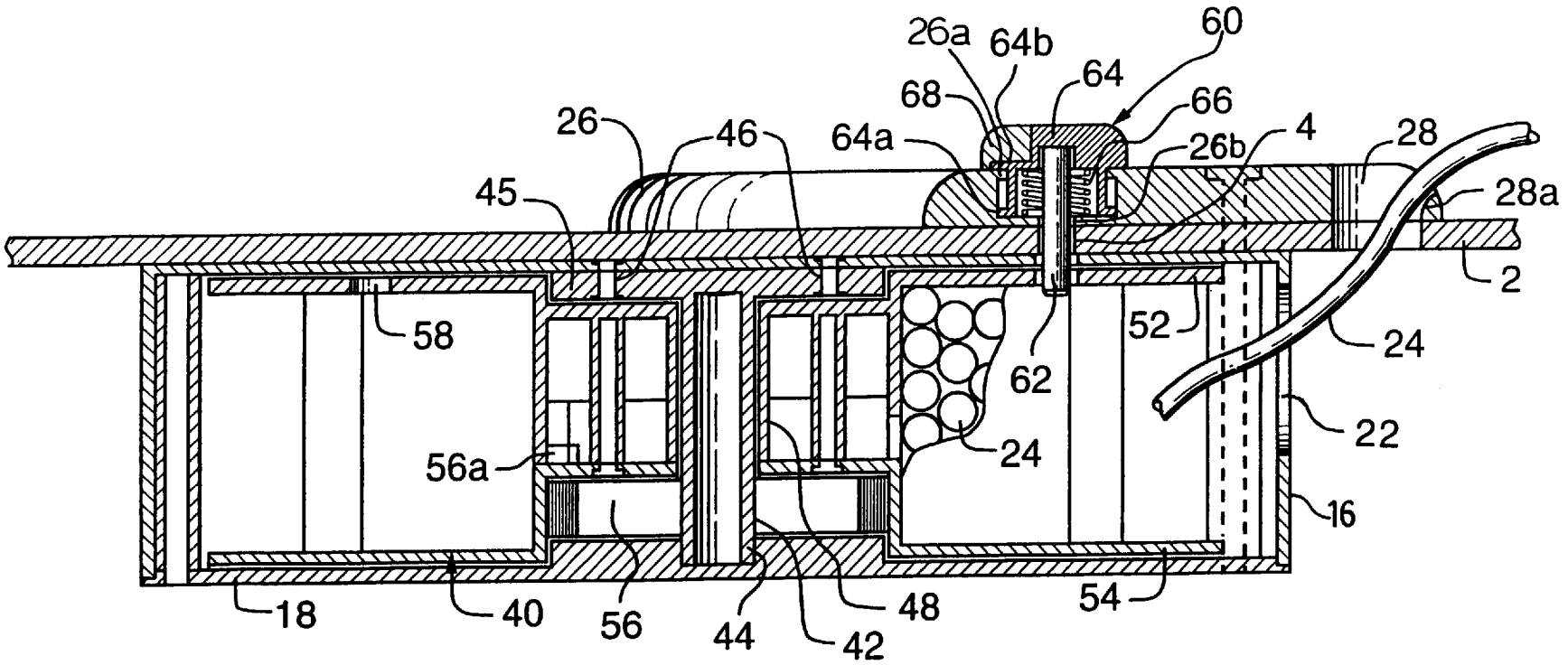
FIG. 2 is a cross-sectional elevation of the embodiment of FIG. 1.
Figure 3:
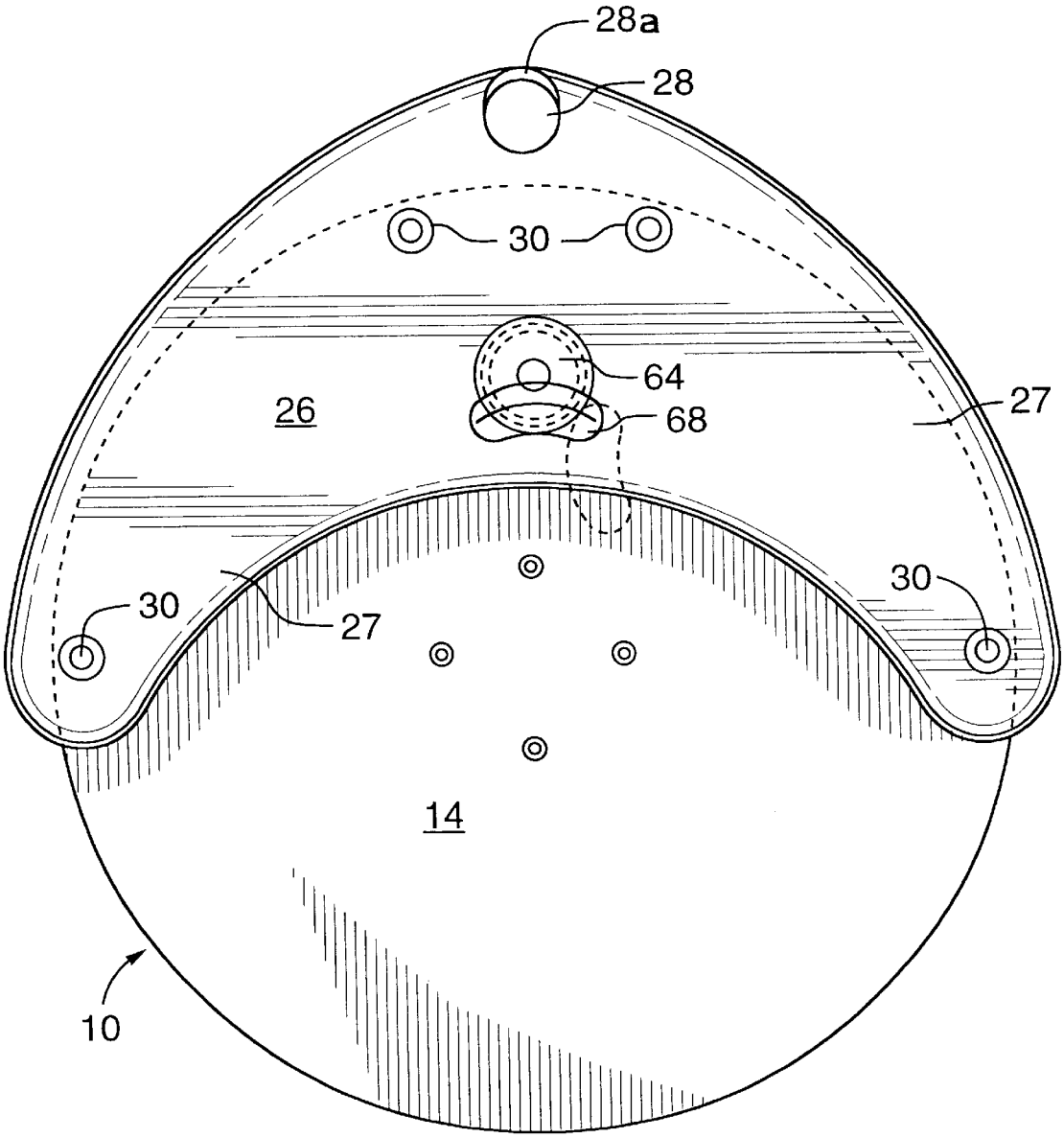
FIG. 3 is a cross-sectional plan view of the embodiment of FIG. 1.
Figure 4:
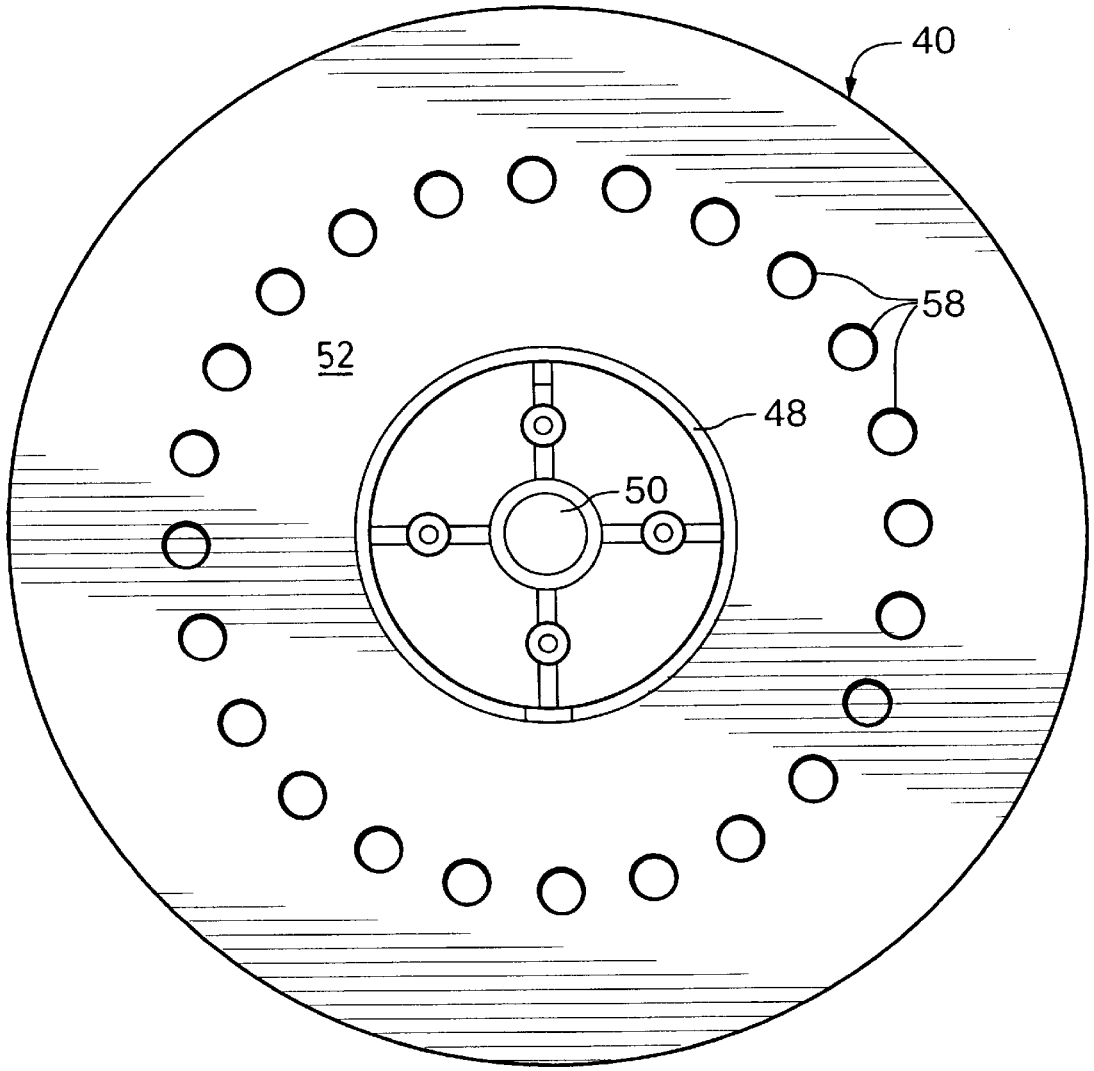
FIG. 4 is a plan view of a payoff reel for the device of FIG. 1.
Figure 7:
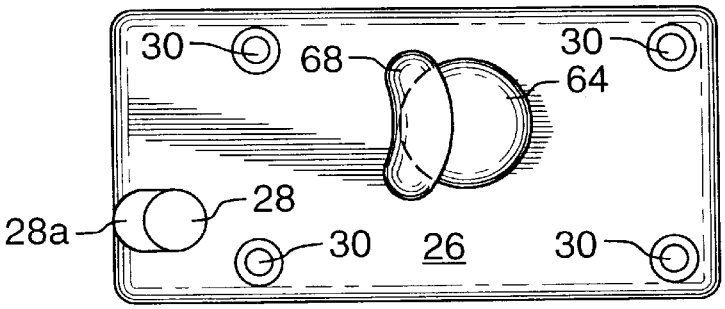
FIG. 7 is a cross-sectional plan view of the embodiment of FIG. 5.

FIGS. 1 to 3 illustrate a first preferred embodiment of a retractable boat line device 10 according to the invention. The device 10 comprises a housing 12, preferably molded from plastic or any other suitable water- and brine-resistant material. In the preferred embodiment the housing 12 comprises an integrally molded face 14 and side wall 16, and is provided with a removable plate 18 affixed to the housing 12 by bolts or screws 20 suitably distributed about the plate 18 to provide a secure and water-resistant seal.

The housing 12 is provided with an opening 22 through which a mooring line 24 egresses, shown formed in the side wall 16 in FIG. 2. The housing 12 is designed to be mounted beneath a mounting surface 2 of the boat, for example within the hull, gunnel or transom, where it is concealed from view and protected from the elements. A mounting plate 26, which may be formed from plastic, stainless or enameled steel or other rigid water- and brine-resistant material, is disposed over the exposed face of the mounting surface 2 and the housing 12 is bolted thereto as by bolts 30. In the preferred embodiment the mounting plate 26 includes an opening 28 through which the mooring line 24 egresses, the opening 28 preferably having an oblique or rounded wall 28*a* to reduce frictional wear on the mooring line 24. The mounting plate 26 serves to reinforce the mounting surface 2, to provide a friction-reduced surface for the mooring line 24, to provide a mount for the locking mechanism 60, and to de-water the mooring line 24 as it is retracted into the housing 12 reducing the possibility of brine, minerals or other dissolved substances in the water from crystallizing inside the housing 12 and interfering with the proper operation of the device 10.

It is not necessary that the mounting plate 26 overlay the entire housing 12; in the embodiment illustrated in FIG. 3 the mounting plate 26 is provided with wings 27 which allow the mounting bolts 30 to be distributed about the mounting surface 2, to thus distribute any force applied to the device 10 when the boat is moored.

A payoff reel 40 is rotatably mounted within the housing 12. In the preferred embodiment the payoff reel 40 is mounted on a stationary axle 42, which may be provided with a flange 45 affixed to the face 14 of the housing 12 as by screws or bolts 46 and is embedded in a recess 44 in the plate 18 for stability, as shown in FIG. 2. The axle 42 may alternatively be mounted to the housing 12 in any other suitable fashion, or formed as part of the reel 40 itself, and the invention is not intended to be limited to the particular manner of mounting the reel 40.

The reel 40 comprises a hub 48 provided with a central opening 50 dimensioned to mount over the axle 42 with sufficient clearance therebetween that the reel 40 rotates relatively freely on the axle 42. The reel 40 further comprises a pair of guide walls 52, 54 which retain the mooring line 24 on the reel 40. The hub 48 is recessed from the guide wall 52 to accommodate the flange 45, and is recessed from the guide wall 54 to accommodate a torsion spring 56 having one end (not shown) affixed to the axle 42 and the other end 56*a* affixed to the hub 48, biasing the reel 40 in the take-up direction to facilitate retraction of the mooring line 24 into the device 10.

The reel 40 is selectively locked to the housing 12 by a locking mechanism 60 comprising a latch 62 cooperating with a plurality of openings 58 disposed about the guide wall 52 at a consistent radial distance from the axle 42, preferably in evenly spaced relation. In the preferred embodiment the latch 62 is mounted through an opening 26*b* in the mounting plate 26 and a concentric opening 4 drilled through the mounting surface 2, and moves linearly between an unlocked position in which the latch 62 is retracted from the guide wall 52 and a locked position in which the latch 62 extends into one of the plurality of openings 58 in the guide wall 52, to thereby rotationally lock the payoff reel 40 to the housing 12. The latch 62 is actuated by a depressable button 64 slidably disposed within the mounting plate 26, preferably retained therein by a lip 64*a* cooperating with a lip 26*a* formed in the mounting plate 26 to prevent dislodgment of the button 64 from the mounting plate 26.

In the preferred embodiment a compression spring 66 biases the button 64 to the unlocked position. A retaining dog 68 is disposed adjacent to the button 66 and pivotably mounted on the mounting plate 26 such that the dog 68 is movable between an unlatched position in which the dog 68 is retracted from the button 64, shown in phantom lines in FIG. 3, and a latched position in which the dog 68 impinges over a ledge 64*b* and retains the button 64 in a depressed condition, as shown in solid lines in FIG. 3.

To install the device 10 of the invention, the housing 12 is mounted beneath the mounting surface 2 of a boat using the mounting plate 26 as a template and drilling holes through the mounting surface 2 to accommodate the mounting bolts 30, the latch 62 and the mooring line 24. Bolts 30 are inserted through the mounting plate 26, through the mounting surface 2 and through the housing 12 and secured with nuts 30*a*. The mooring line 24 is fed through the opening 22 in the housing 12 and through the opening 28 in the mounting plate 26, and may be knotted to prevent retraction through the opening 28 or if desired a hook or other fastening element (not shown) may be tied to the end of the mooring line 24.

In operation, the mooring line 24 is extended to the mooring structure by manually drawing on the mooring line 24 to overcome the biasing force of the spring 56 on the reel 40. The mooring line is paid off of the reel 40 and egresses through openings 22 and 28. When the desired mooring line 24 has been secured to the mooring structure, the button 64 is depressed to rotationally lock the reel 40. The line 24 may have to be adjusted slightly to align one of the openings 58 with the latch 62, at which point the latch 62 engages into an opening 58 and the button 64 can be fully depressed. The retaining dog 68 is pivoted from the unlocked position to the locked position, as shown in FIG. 3, to impinge over the ledge 64*b* and retain the button 64 in the locked condition. The mooring line 24 is thus locked to the selected length.

To retract the mooring line 24 the line 24 is detached from the mooring structure, the retaining dog 68 is pivoted away from the button 64 to the unlocked position and the spring 66 forces the button 64 to the unlocked position, retracting the latch 62 from the opening 58. The reel 40 is then free to rotate, and the spring 56 rotates the reel 40 in the take up direction to retract the mooring line 24 into the housing 12. The guide walls 52, 54 guide the mooring line 24 onto the reel 40 for storage.

Figure 8:
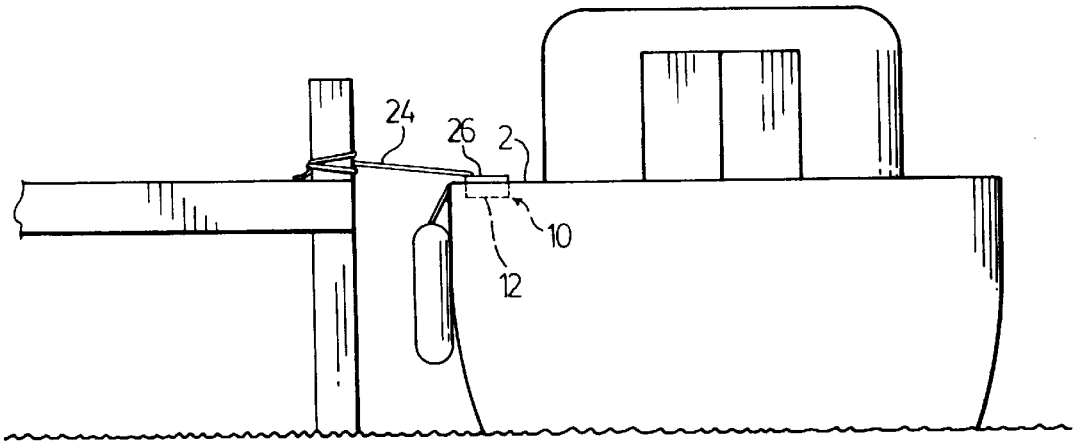
FIG. 8 is a front elevation of the device of FIG. 1 mounted in the hull of a boat.
Figure 9:
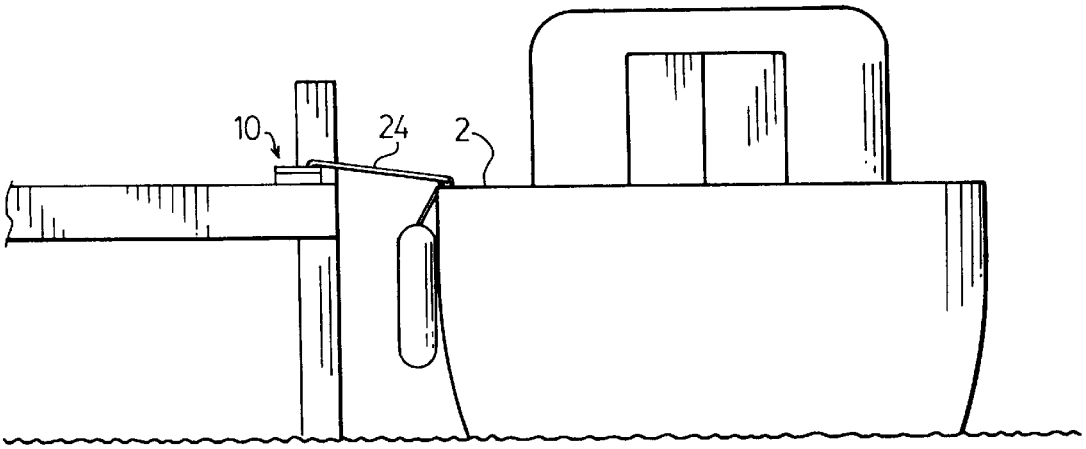
FIG. 9 is a front elevation of the device of FIG. 1 mounted on a pier.

It will be appreciated that while the retractable mooring line of the invention is advantageously mounted concealed beneath the mounting surface 2, as shown in FIG. 8, the device 10 may alternatively be mounted on any suitable exposed surface of the boat and the mounting plate 26 could in such an embodiment be mounted beneath the mounting surface 2 for reinforcement. Alternatively, as shown in FIG. 9 the device 10 can be mounted on (or beneath) a pier, and operates in the manner described above except that the mooring line 24 is paid off from the pier and affixed to the boat in any suitable fashion, such as to an available cleat.

Figure 5:
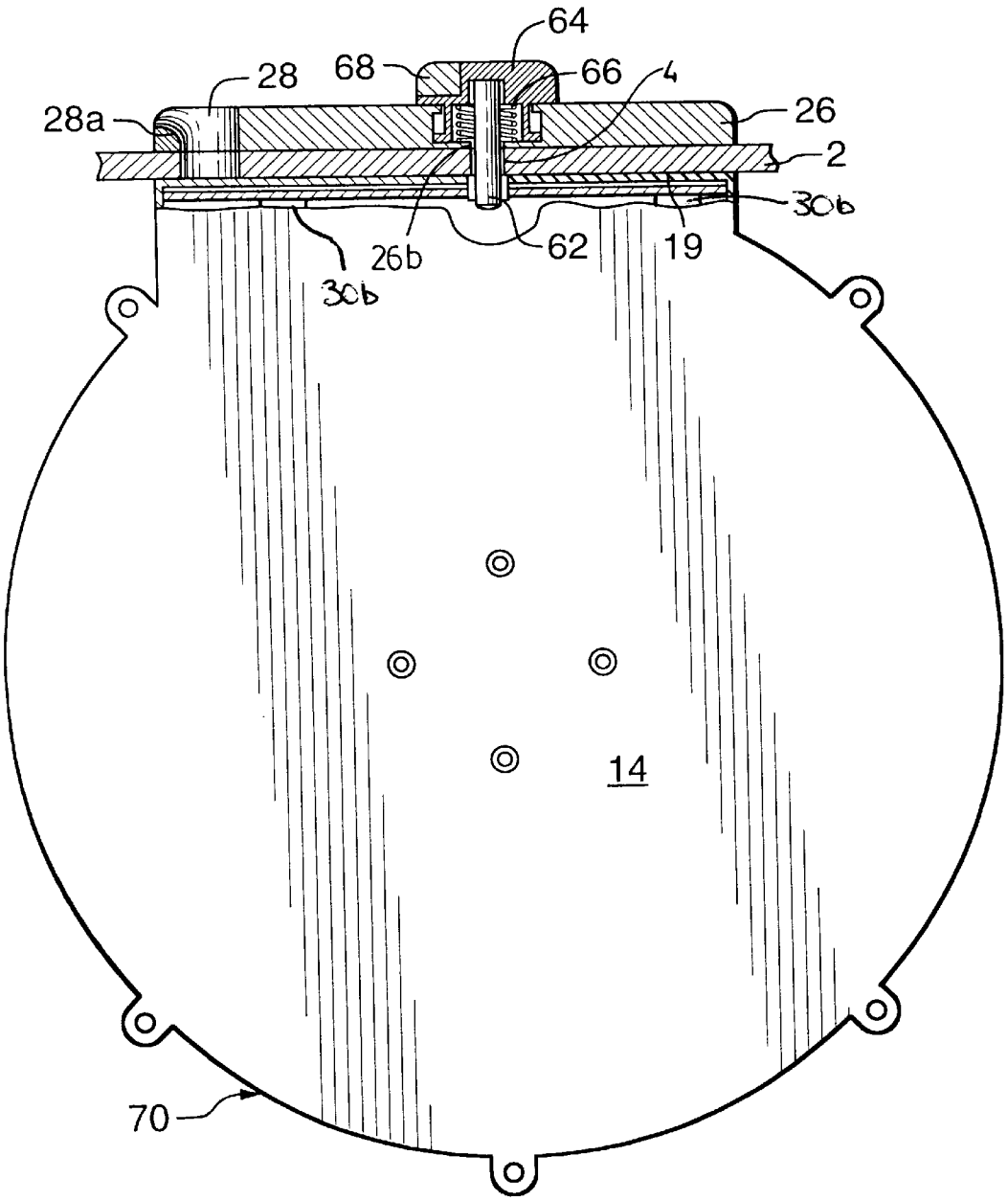
FIG. 5 is a side elevation of a further preferred embodiment of the invention for mounting vertically to a mounting surface on a boat.
Figure 6:
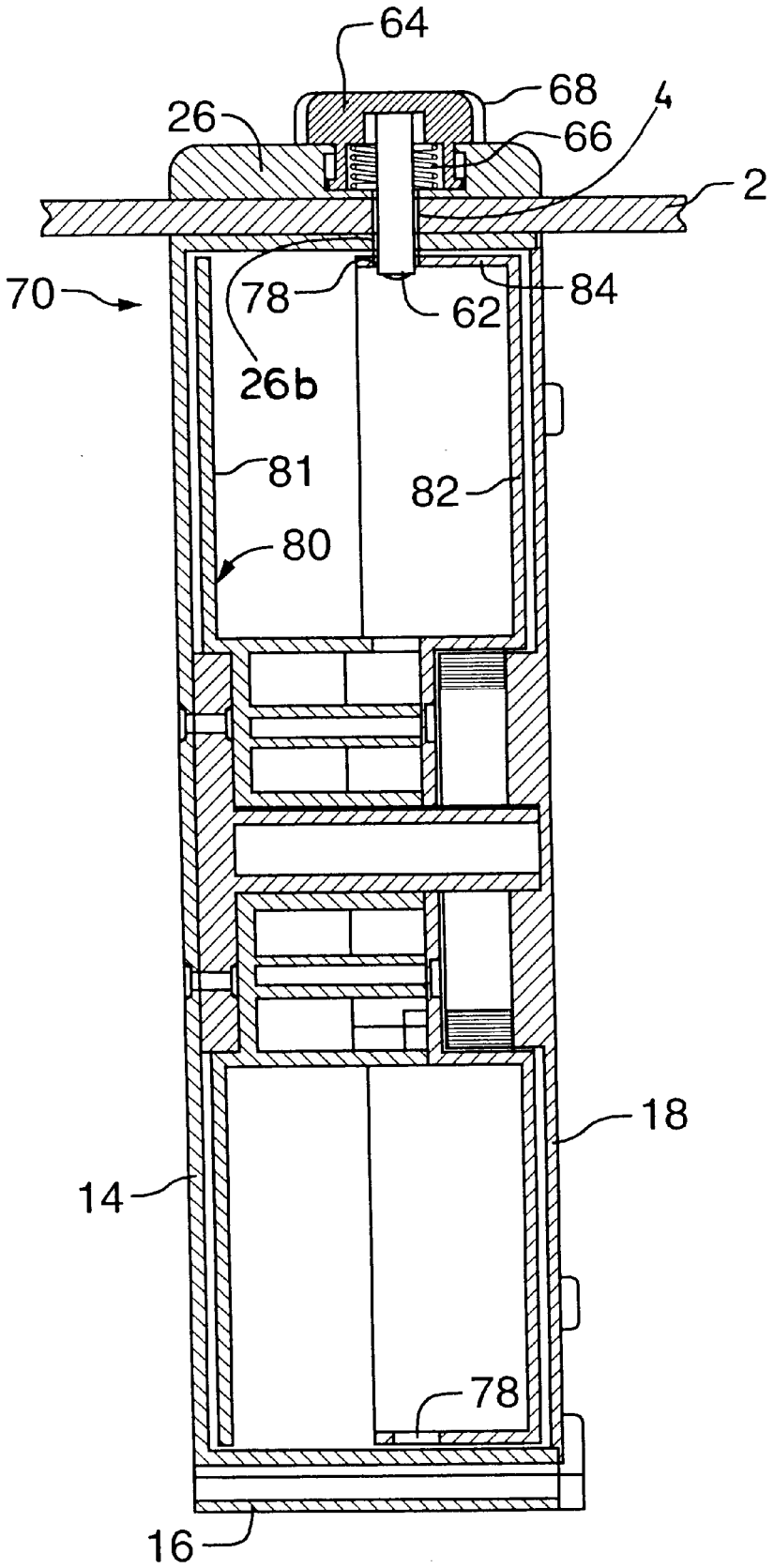
FIG. 6 is a cross-sectional elevation of the embodiment of FIG. 5.

A further embodiment of the invention is illustrated in FIGS. 5 to 8. In this embodiment the device 70 is designed to be mounted in a vertical orientation, for example within a transom or gunnel where space does not permit a lateral mount. The housing 12 is configured substantially as in the previously described embodiment, but is provided with a flat region 19 for abutting the mounting surface 2 for a secure mount. The mounting plate 26 is affixed to the housing 12 by bolts 30 inserted into threaded sockets 30*b* formed in the housing 12, as shown in FIG. 5.

The linear motion of the latch 62 is retained, so that in this embodiment the latch 62 moves in the radial direction relative to the reel 80. Thus, in this embodiment one of the guide walls 82 of the reel 80 is provided with a circumferential extension 84, best seen in FIG. 8, which may be formed integrally with outer periphery of the guide wall 82. The extension 84 extends in the axial direction, leaving sufficient clearance between the edge of the extension 84 and the opposite guide wall 81 to allow the mooring line 24 to freely wind onto and unwind from the reel 80. A plurality of openings 78 are provided in the extension 84 in alignment with the latch 62, which engages into an opening 78 when the button 64 is depressed. The operation of this embodiment is otherwise substantially similar to the operation of the embodiment of FIGS. 1 to 3.

Preferred embodiments of the invention having been thus described by way of example only, it will be apparent to those skilled in the art that certain modifications and adaptations may be made without departing from the scope of the invention, as set out in the appended claims.

We claim:

1. A retractable mooring line for mooring a boat, comprising a stationary housing for mounting the device to a surface of a boat, a payoff reel having opposed guide walls rotatably mounted within the housing such that the payoff reel rotates in a plane substantially perpendicular to the surface, said guide walls retaining the mooring line on the reel, for extending and retracting the mooring line, and a locking mechanism comprising at least one latch disposed in alignment with a plurality of openings provided in a circumferential extension of a radial periphery of one guide wall, the circumferential extension extending toward the other of said opposed guide walls with a clearance between the circumferential extension and the other of said opposed guide walls to allow the mooring line to freely unwind from the payoff reel, and the latch being movable upon actuation of an actuating member between an unlocked position in which the latch is retracted form the at least one guide wall and a locked position in which the latch extends into at least one of the plurality of openings to thereby rotationally lock the payoff reel to the housing, wherein when the device is mounted to a surface of a boat the actuating member is exposed for manual actuation and the mooring line is exposed for extension to a mooring structure.

2. The device of claim 1 in which the latch is moved between the unlocked and locked positions by a manually actuable button depressable in a direction of motion of the latch.

3. The device of claim 2 which a retaining dog adjacent to the button is movable between an unlatched position in which the dog is retracted from the button and a latched position in which the dog retains the button in a depressed condition.

4. The device of claim 3 in which the button is biased to the unlocked position.

5. The device of claim 1 in which the reel is biased to rotate in a take-up direction for retracting the mooring line.

6. The device of claim 1 in which the device is adapted for mounting the housing beneath the surface of the boat.

7. A retractable mooring line for mooring a boat, comprising a stationary housing for mounting the device, a payoff reel rotatably mounted within the housing having guide walls for retaining the mooring line on the reel, for extending and retracting the mooring line, and a locking mechanism comprising at least one latch mounted through the housing disposed in alignment with a plurality of openings provided in a radial surface of at least one guide wall, the latch being movable upon actuation of an actuating member between an unlocked position in which the latch is retracted from the at least one guide wall and a locked position in which the latch extends into at least one of the plurality of openings to thereby rotationally lock the payoff reel to the housing, wherein when the device is mounted to a surface of a boat such that the payoff reel rotates in a plane substantially parallel to the surface, the actuating member being exposed for manual actuation and the mooring line being exposed for extension to a mooring structure.

8. The device of claim 7 in which the latch is moved between the unlocked and locked positions by a manually actuable button depressable in a direction of motion of the latch.

9. The device of claim 8 in which a retaining dog adjacent to the button is movable between an unlatched position in which the dog is retracted from the button and a latched position in which the dog retains the button in a depressed condition.

10. The device of claim 9 in which the button is biased to the unlocked position.

11. The device of claim 7 in which the reel is biased to rotate in a take-up direction for retracting the mooring line.

12. The device of claim 7 in which the device is adapted for mounting the housing beneath the surface of the boat.

* * * * *